US005406703A

United States Patent [19]

Haen et al.

[11] Patent Number: 5,406,703

[45] Date of Patent: Apr. 18, 1995

[54] METHOD OF MAKING A TUBE BURNER FOR COOKING APPARATUS

[75] Inventors: William G. Haen; John D. Poulsen, both of Racine, Wis.

[73] Assignee: Greene Manufacturing Company, Racine, Wis.

[21] Appl. No.: 133,988

[22] Filed: Oct. 12, 1993

[51] Int. Cl.[6] ..... B23P 15/00

[52] U.S. Cl. ..... 29/890.02; 29/469.5; 29/557; 431/286

[58] Field of Search ..... 29/890.02, 469.5, 513, 29/514, 521, 557; 431/286

[56] References Cited

U.S. PATENT DOCUMENTS

| | | | |
|---|---|---|---|
| 457,245 | 8/1891 | Betts . | |
| 1,527,210 | 2/1925 | O'Hare et al. | 29/890.02 |
| 1,908,668 | 5/1933 | Hollman . | |
| 2,560,777 | 7/1951 | Reeves | 158/116 |
| 2,670,790 | 3/1954 | Marble | 158/114 |
| 3,154,037 | 10/1964 | Mayrath | 113/34 |
| 3,177,923 | 4/1965 | Hine, Jr. et al. | 158/116 |
| 3,540,258 | 11/1970 | Branson | 29/890.02 |
| 3,578,891 | 5/1971 | Cavestany et al. | 431/191 |
| 3,694,133 | 9/1972 | Wilkerson | 431/191 |
| 3,728,881 | 4/1973 | Coop | 29/521 |
| 4,395,230 | 7/1983 | Berry | 431/286 |
| 4,416,249 | 11/1983 | Reynolds et al. | 126/41 R |
| 4,418,456 | 12/1983 | Riehl | 29/890.02 |
| 4,796,797 | 1/1989 | Nakako et al. | 228/144 |
| 4,951,880 | 8/1990 | Riehl | 29/890.02 |
| 4,986,254 | 1/1991 | Haen et al. | 126/41 R |

FOREIGN PATENT DOCUMENTS

| | | | |
|---|---|---|---|
| 4025060 | 2/1991 | Germany | 29/840.02 |
| 0116016 | 9/1980 | Japan | 29/890.02 |
| 1601953 | 11/1981 | United Kingdom | 431/286 |

OTHER PUBLICATIONS

Diagrams from relevant pages of "High-Production Roll Forming published by Society of Manufacturing Engineers".

*Primary Examiner*—Irene Cuda

*Attorney, Agent, or Firm*—Jansson & Shupe, Ltd.

[57] ABSTRACT

A cooking-type elongate bar burner having a plurality of gas flow apertures and a top surface is defined in part by a stiffening ridge and by a pair of laterally extending flanges. The apertures are beneath the flanges and thereby substantially protected from grease clogging. The burner is roll formed of a single piece of sheet material and is configured to directly accept a gas flow control valve. Also a unique "intra-burner" cross-over ignition arrangement and a method for making the new burner by roll forming are described.

11 Claims, 10 Drawing Sheets

FIG. 2
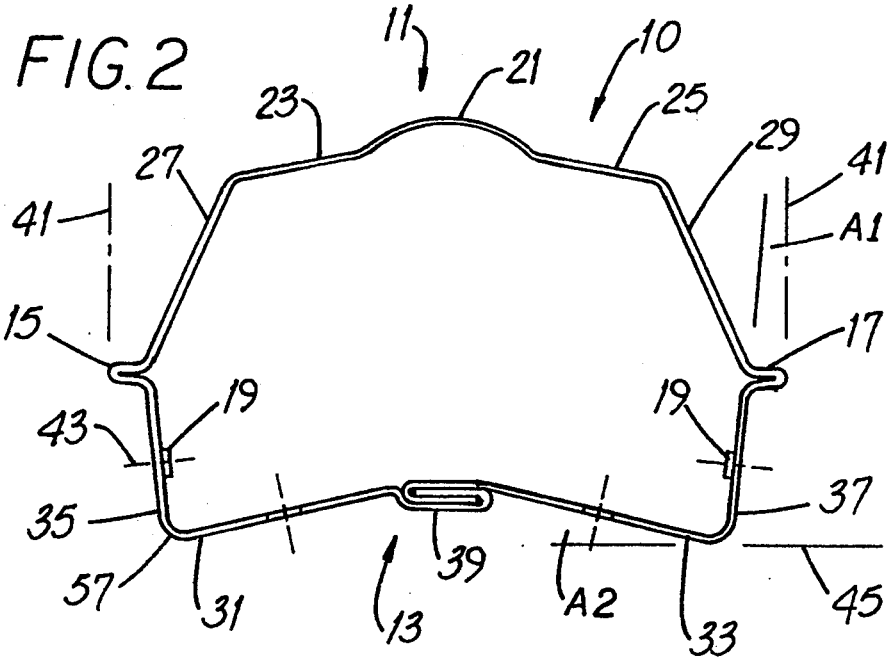
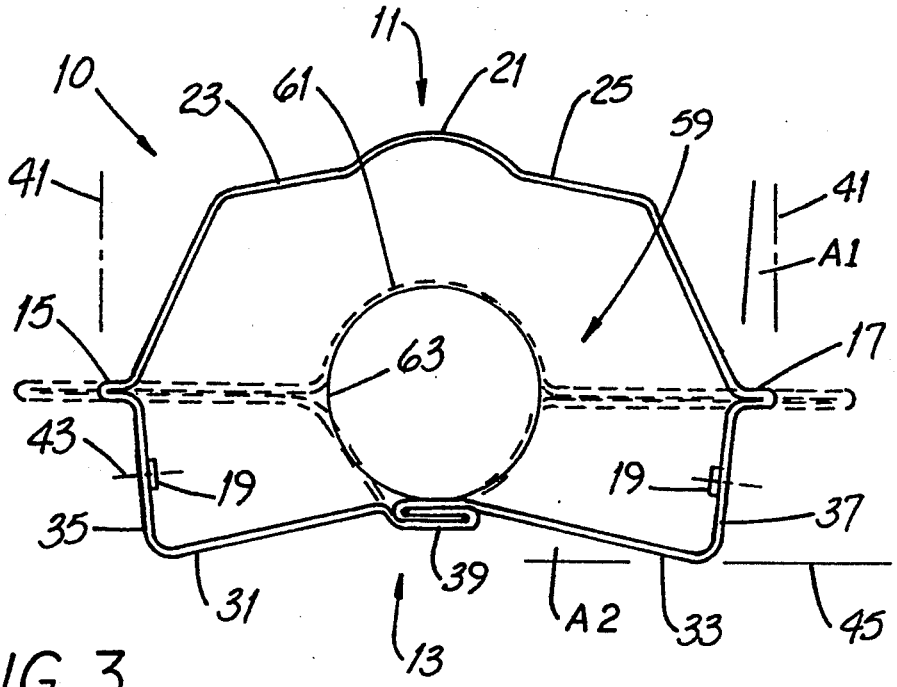
FIG. 3

METHOD OF MAKING A TUBE BURNER FOR COOKING APPARATUS

FIELD OF THE INVENTION

This invention is related generally to combustion and, more particularly, to stoves and furnaces.

BACKGROUND OF THE INVENTION

Vaporized fuel such as natural gas or propane is mixed with air and used for cooking in oven broilers, gas ranges and gas-fired cooking grills. The burners used when combusting such fuel mixture have any of a wide variety of shapes such as circular, H-shaped, U-shaped, bar-shaped and, probably, others. Prior art burners are shown in U.S. Pat. Nos. 1,908,668 (Hollman); 2,670,790 (Marble); 4,118,175 (Riehl); 4,416,249 (Reynolds); 4,488,534 (Koziol); 4,773,384 (Koziol); 4,986,254 (Haen et al.) and 5,062,788 (Best).

The bar burner shown in the Haen et al. patent has two portions, each of which is separately fed with a fuel/air mixture. Each portion has a diminishing cross-sectional area for reasons explained in the patent and the burner is fabricated using two hollow "shells" attached together by crimping.

The Holman and Reynolds patents also show types of bar burners, the former being cast and the latter being made of tubing with holes formed along its length. The burner shown in the Reynolds patent has what the patent calls a radiant attached to the top thereof. The construction shown in the Marble patent effects cross-over ignition of main burners.

Certain disadvantages attend the prior art burners. For example, the gas jets of the burner shown in the Reynolds patent are exposed to grease dripping from above. Grease tends to clog gas jets and impair burner performance.

Yet another disadvantage involves the matter of "intra-burner" cross-over ignition, i.e., prompt ignition of all rows of gas jets in a particular burner. Insofar as is known, earlier workers in this field have failed to develop a highly effective arrangement for good intra-burner cross-over ignition, particularly in a long, thin tube-type bar burner.

Another disadvantage of prior art burners is that their designers have not fully appreciated how to "integrate" the burner and gas control valve without resorting to additional connection hardware, fittings and the like. The Koziol '534 patent shows a typical prior art arrangement.

Another disadvantage of prior art burners is that they are manufactured by relatively expensive methods, e.g., casting or fabrication of separate parts with subsequent assembly of such parts. Roll forming per se is known (see, for example, U.S. Pat. No. 4,796,797 (Nakako et al.) and is used to make such relatively simple products as metal pipes and refrigerator door handles. However, insofar as is known (and until the advent of the invention), workers in the field of cooking burners did not appreciate and master the use of roll forming techniques to make an elongate bar burner of relatively complex shape.

The invention addresses these disadvantages in a unique, highly-innovative way.

OBJECTS OF THE INVENTION

It is an object of this invention to provide an improved tube burner and a method of making such a burner which overcomes some of the problems and shortcomings of the prior art.

Another object of this invention is to provide an improved tube burner having gas flow apertures which are shielded from dripping liquid.

Another object of this invention is to provide an improved tube burner having a highly-effective intra-burner cross-over ignition arrangement.

Still another object of this invention is to provide an improved tube burner configured to connect directly to a gas flow control valve.

Yet another object of this invention is to provide an improved tube burner which is roll formed.

Still another object of this invention is to provide a method for roll forming a tube burner. How these and other objects are accomplished will become apparent from the following descriptions and from the drawing.

SUMMARY OF THE INVENTION

The invention involves improvements in a cooking-type elongate tube burner having a plurality of gas flow apertures and a top surface. In an aspect of the invention, the top surface is defined in part by a pair of laterally extending flanges and the apertures are beneath the flanges and thereby substantially protected from grease clogging. The burner is roll formed of a single piece of sheet material.

More specifically, the apertures are formed in each of a pair of side strips and each strip is angled inward from a vertical reference plane. In one preferred embodiment, each side strip and a reference plane define an included acute angle in the range of 2° to 8°, and most preferably, define an included angle of about 5°. Each side strip has at least one gas flow aperture directing gas along a flow axis and because of the slight "tilt" or angularity of each side strip, each of the flow axes intersects a reference plane mentioned below.

The new burner also has complementary first and second bottom panel portions, each of which is contiguous with a separate side strip. Each bottom panel portion is angled (e.g., upward) with respect to a plane such as a horizontal reference plane. In one preferred embodiment, the angle defined by the plane and at least one bottom panel portion is in the range of 7° to 20° and, most preferably, is about 13°.

In a highly preferred embodiment, each bottom panel portion is angled to face somewhat toward the other bottom panel portion and each bottom panel portion has at least one ignition port. An ignition port in the first bottom panel portion directs gas along a first axis and, similarly, an ignition port in the second bottom panel portion directs gas along a second axis. The axes intersect, facilitating cross-over ignition.

It has been discovered that the rapidity with which crossover ignition occurs in the burner is a function of the angle of the side strips from vertical and of the angle of the bottom panels from horizontal. Where each of those angles is more shallow. i.e., in the range of 2° to 8° and 7° to 20°, respectively, it is desirable to have several bottom panel ignition ports and an ignition port at the edge at which a side strip and the contiguous bottom panel are joined.

Stating it otherwise, the burner includes (in addition to a side strip) a bottom panel angled upward from a horizontal reference plane. The bottom panel and the side strip are joined along an edge, the bottom panel includes a plurality of ignition ports and the burner has a notch-like ignition port at the edge.

In a highly preferred arrangement, the ignition ports in the bottom panel are aligned "on line" with the ignition port at the edge and the ignition port at the edge is substantially directly below an aperture in the side strip. In that way, ignition at any one of the ignition ports propagates along the "row" of ignition ports, to the edge ignition port and thence to the apertures in the side strip.

In other aspects of the invention, the burner includes an entry end crimped to define a tube-like valve receptacle for receiving a gas flow control valve. In one preferred embodiment, the burner has at least one primary air inlet passage adjacent to and oriented generally parallel to the receptacle. In another preferred embodiment, the receptacle has a distal end defining a venturi. The valve has a distal end within the receptacle and spaced from the venturi and the burner has a primary air passage between the venturi and the distal end.

The invention also involves a method for making a roll-formed tube burner. Such method includes the steps of providing an elongate strip of material having (a) a central portion, (b) a first lateral portion and (c) a second lateral portion. Preferably, both lateral portions are contiguous with the central portion. Aspects of the method involve both piercing and deforming an elongate strip of, e.g., sheet steel or aluminum.

Prior to the first deforming step, it is preferable to pierce the gas flow apertures in the strip and if the burner is to have an air inlet passage and/or an ignition port, it is highly preferred to pierce the apertures the passage and the port prior to deformation.

A press is used for performing the piercing operation(s) prior to entry of the strip into the first of several stages of roll forming. Once roll forming begins, it is much preferred to avoid interposing any non-roll forming operation between any pair of roll forming stages. After piercing and at the first stage of roll forming, the lateral portions of the strip are knurled so that when the tabs are interlocked, they seal properly to substantially prevent the escape of fuel through the lock seam.

In the deformation steps, the central portion is deformed to define a burner first panel having a burner ridge portion and a pair of flange portions. In the finished burner, the ridge portion provides rigidity and helps direct liquid grease to a location where it drips harmlessly from the burner. The flange portions help shield the gas flow apertures from grease dripping from cooking food directly above the apertures and from grease which has dripped onto the burner and runs down the burner.

Each lateral portion is deformed to provide a tab therealong and to define a burner second panel. Preferably, deformation of each lateral portion includes the steps of deforming the first lateral portion to provide a first tab extending away from a reference plane and deforming the second lateral portion to provide a second tab extending toward the reference plane. When so made, the tabs are readily interlocked (somewhat like interlocking the bent fingers of two hands) to form a lock seam and an elongate tube-like structure is thereby provided.

As noted above, deformation of each lateral portion also defines a burner second panel. Each lateral portion is bent to provide a burner side strip portion and a burner bottom panel portion. Preferably, such bending of each lateral portion is in a manner such that apertures are along each side strip portion and each bottom panel portion includes at least one ignition port.

After the tabs are interlocked, the resulting tube-like structure preferably has a substantially uniform cross-sectional area and shape. Such structure could be closed by plugs at the ends and a fuel/air fixture fed thereinto along a tube threaded into one of the plugs. However, in a highly preferred method, the interlocking step is followed by the step of crimping an end of the structure to form a cylinder-like receptacle. The invention effects certain economies in that the receptacle directly receives a gas valve without the need for any extra hardware, gas flow tube mounting devices or the like.

The other end of the structure is also crimped closed to prevent leakage of fuel/air mixture therefrom. In one specific arrangement, such closed end is also bent to form a mounting tongue which quickly attaches to a bracket in the cooking kettle.

Further details of the invention are set forth in the following detailed description and in the drawing.

BRIEF DESCRIPTION OF THE DRAWING

FIG. 2 is an end elevation view of the burner of FIG. 1.

FIG. 3 is, generally, an end elevation view of the burner of FIGS. 1 and 2 with a crimped end portion thereof shown in dashed outline.

Detailed Descriptions of the Preferred Embodiments

Figure 1:
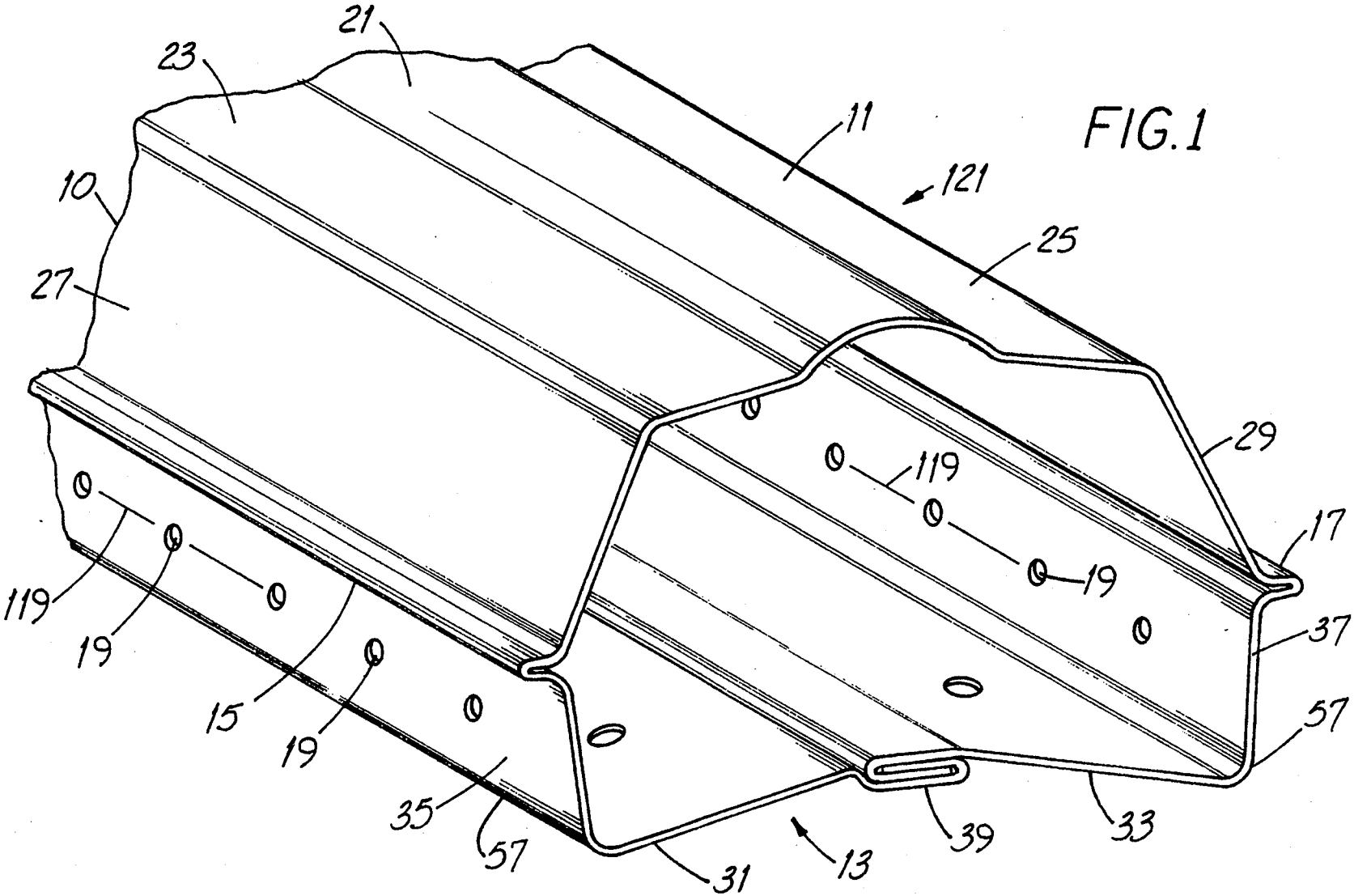
FIG. 1 is a perspective view of aspects of the roll-formed tube burner of the invention. Parts are broken away and other parts are omitted for clarity.

The invention involves a new roll-formed tube burner 10 and a method for making such a burner 10. Structural features of the burner 10 will be described first.

In this specification, terms of perspective and orientation are used such as "top," "side," "bottom," "left" and the like. It is to be appreciated that such terms are used to coordinate the textual description with the drawing and are not limiting.

Referring first to FIGS. 1–4, the new burner 10 has a first or top panel 11 and a second or bottom panel 13, each of which is generally bounded by and contiguous with a pair of laterally-extending flanges 15, 17. Such flanges 15, 17 are "roof-like" to the gas flow apertures 19 in that they help protect such apertures 19 from grease clogging. (Such apertures 19 are referred to as "gas flow apertures" in that a combustible mixture of gaseous fuel and air flows through them. Such mixture is sometimes referred to as "gas" wherein. When the mixture is ignited, the resulting flame provides heat used for cooking.)

The top panel 11 has a curved, rib-like central ridge portion 21 for rigidity and a pair of first sloping portions 23, 25 one extending slightly angularly downward on either side of the ridge portion 21. A second sloping portion 27 or 29 extends more steeply from each first portion 23 or 25 to a flange 15 or 17.

The bottom panel 13 includes complementary first and second bottom panel portions 31 and 33, respectively, and a side strip 35 or 37, respectively, extending angularly upward and slightly outward from each bottom panel portion 31 or 33. The bottom panel portions 31, 33 are joined by a substantially gas-tight lock seam 39.

More specifically, plural apertures 19 are linearly-aligned and formed in each of the side strips 35, 37. Each strip 35, 37 is preferably tipped or angled inward from a vertical reference plane 41.

In the embodiment of FIGS. 2 and 3, a side strip and a reference plane define an included acute angle "A1" in the range of 2° to 8°, and most preferably, define an included angle of about 5°. Each side strip has at least one gas flow aperture 19 directing gas along a flow axis 43 and because of the slight "tilt" or angularity of each side strip 35, 37 each of the flow axes 43 intersects a horizontal reference plane 45 mentioned below. In a highly preferred embodiment, each aperture 19 directs gas along a separate flow axis 43 substantially parallel to the flow axis 43 of other apertures 19. It should also be noted that because of the tilt or angularity of the side strips 35, 37 as described above, the burner 10 provides improved heat distribution.

Further, each bottom panel portion is angled with respect to the plane 45 and the angle "A2" defined by the plane 45 and a bottom panel portion 31, 33 is in the range of 7° to 20° and, most preferably, is about 13°. As described below in connection with FIGS. 5 and 6, a burner 10 having these angular relationships provides best ignition when a plurality of ignition ports 47 are used in each bottom panel portion 31, 33 and when an edge ignition port 49 is also used.

Figure 4:
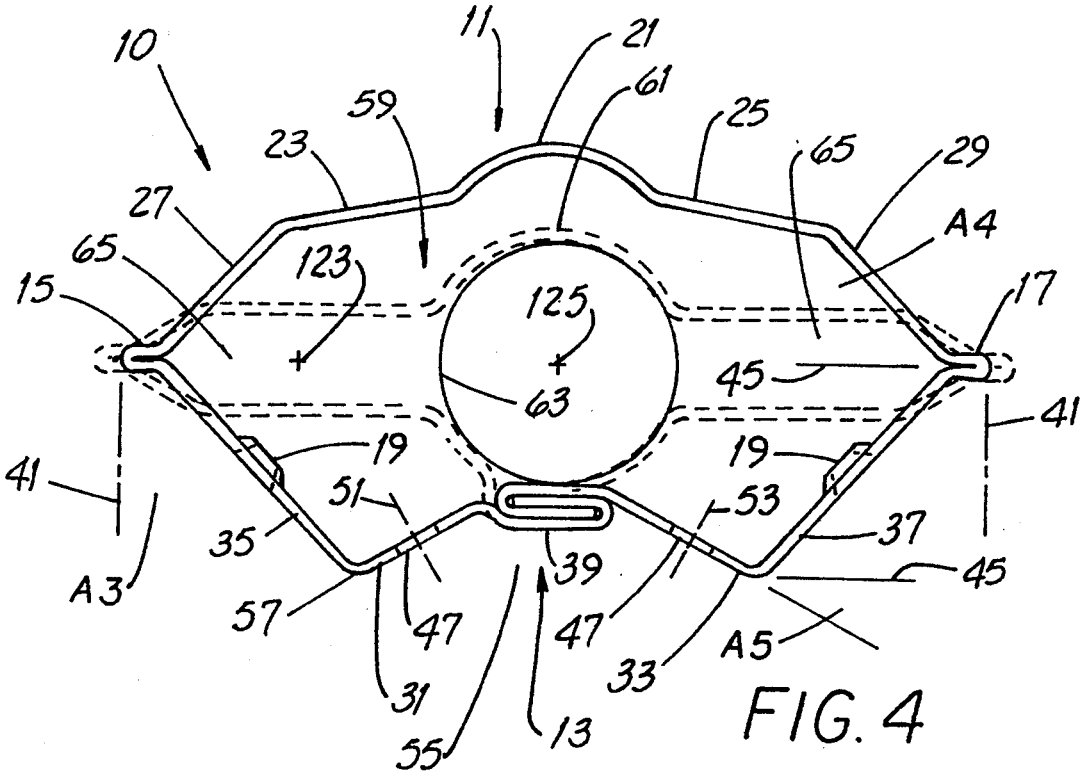
FIG. 4 is, generally, an end elevation view like that of FIG. 3 and showing another embodiment of the burner.

In the embodiment of FIG. 4 a side strip 35, 37 and a vertical reference plane 41 define an included acute angle "A3" in the range of 35° to 55° and, most preferably, define an included angle of about 45°. A second portion 27, 29 and the horizontal reference plane 45 define an included angle "A4" in the range of 45° to 65° and, most preferably, define an included angle "A4" of about 55°.

Further, each bottom panel portion 31, 33 is angled with respect to a horizontal reference plane 45 and the included acute angle "A5" between such a portion 31, 35 and the plane is in the range of 15° to 25° and, most preferably, is about 20°. In this embodiment, it has been discovered that rapid burner ignition occurs with but one ignition port 47 in each bottom panel portion.

In a highly preferred embodiment, each bottom panel portion 31 or 33 is angled to face somewhat toward the other bottom panel portion 33 or 31 and each bottom panel portion 31, 33 has at least one ignition port 47. An ignition port 47 in the first bottom panel portion 31 directs gas along a first axis 51 and, similarly, an ignition port 47 in the second bottom panel portion 33 directs gas along a second axis 53 which intersects axis 51. This arrangement greatly facilitates cross-over ignition. That is, a flame (ignited by a conventional separate igniter, not shown) projecting from the left port 47 and along axis 51 will ignite the gas flowing from the right port 47 and along axis 53 since the flame and such gas come in contact with one another.

An industry standard promulgated by the American Gas Association requires ignition of an entire tube burner within 4 seconds. The improved burner 10 provides very rapid ignition of the entire burner 10, i.e., within about 1.5–2 seconds.

While not wishing to subscribe to any particular theory as to why the new arrangement is so effective in this regard, it is believed that cross-over ignition occurs as follows. If gas flowing from only one ignition port (e.g., left port 47) is ignited, the flame and the raw gas from the other ignition port (e.g., right port 47) are directed toward one another and the latter quickly ignites. Another factor is that, apparently, unignited gas from the right port 47 rises and collects in the shallow inverted V-shaped space 55 adjacent to the seam 39. Similarly some of the very hot product of combustion from the flame also rises toward the same space 55. The temperature of such product is adequate to ignite the raw gas collecting in such space 55.

While cross-over ignition is occurring or after it has occurred, some of the very hot product of combustion also flows along a bottom panel portion 31, 33, e.g., the first portion 31, toward and around the edge 57 and upward along the side strip 35. Such product thereupon contacts gas flowing from an aperture 19 and ignites it. Ignition of gas flowing from other apertures 19 on that side strip 35 follows immediately. And, of course, the same events occur with respect to ignition of gas from apertures 19 on the right side of the burner 10.

In other aspects of the invention, the burner 10 includes an entry end 59 crimped to define a tube-like valve receptacle 61 for receiving a gas flow control valve 63. In one preferred embodiment shown in FIG. 4, the burner 10 has at least one primary air inlet passage 65 adjacent to and oriented generally parallel to the receptacle 61. In another preferred embodiment shown in FIGS. 3, 5, 6, 7 and 8, the receptacle 61 has a distal end 67 defining a venturi passage 69. The valve 63 has a distal end 71 within the receptacle 61 and spaced from the venturi passage 69 and the primary air passage 65 is between the venturi passage 69 and the valve distal end 71.

Figure 5:
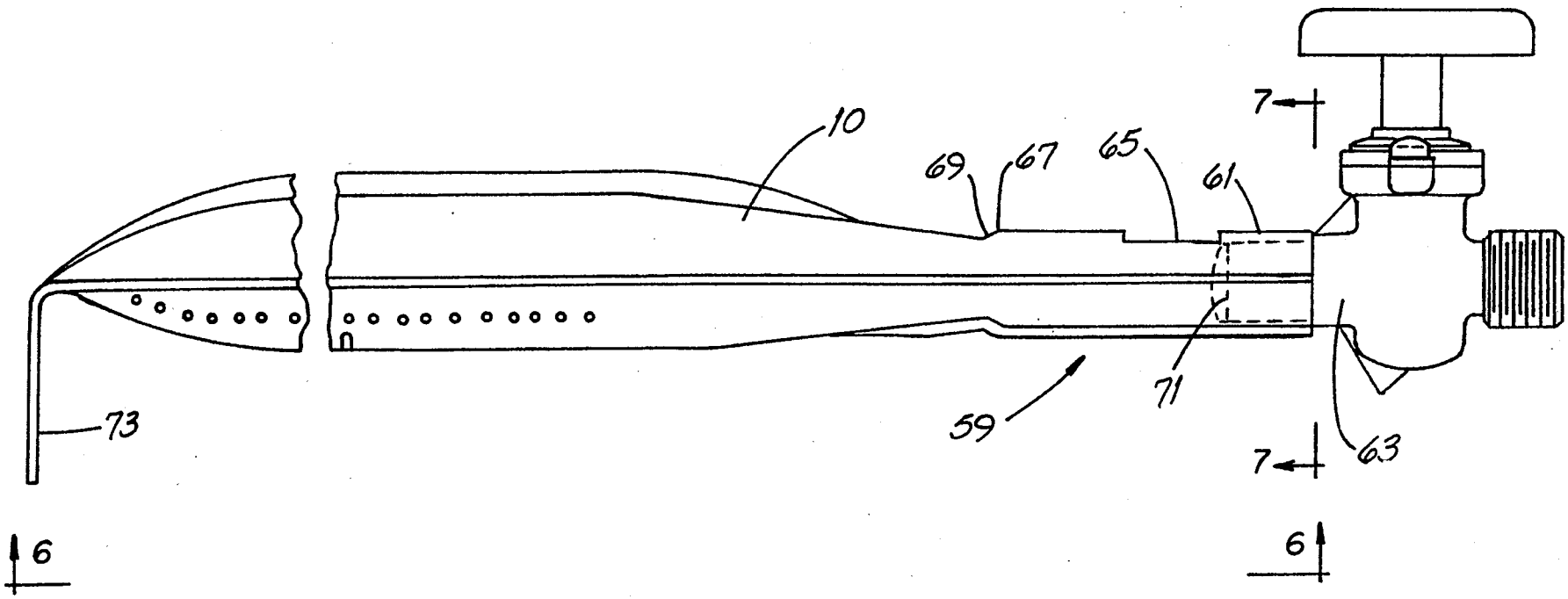
FIG. 5 is a side elevation view of a burner shown in conjunction with a gas flow control valve. Parts are broken away.
Figure 6:
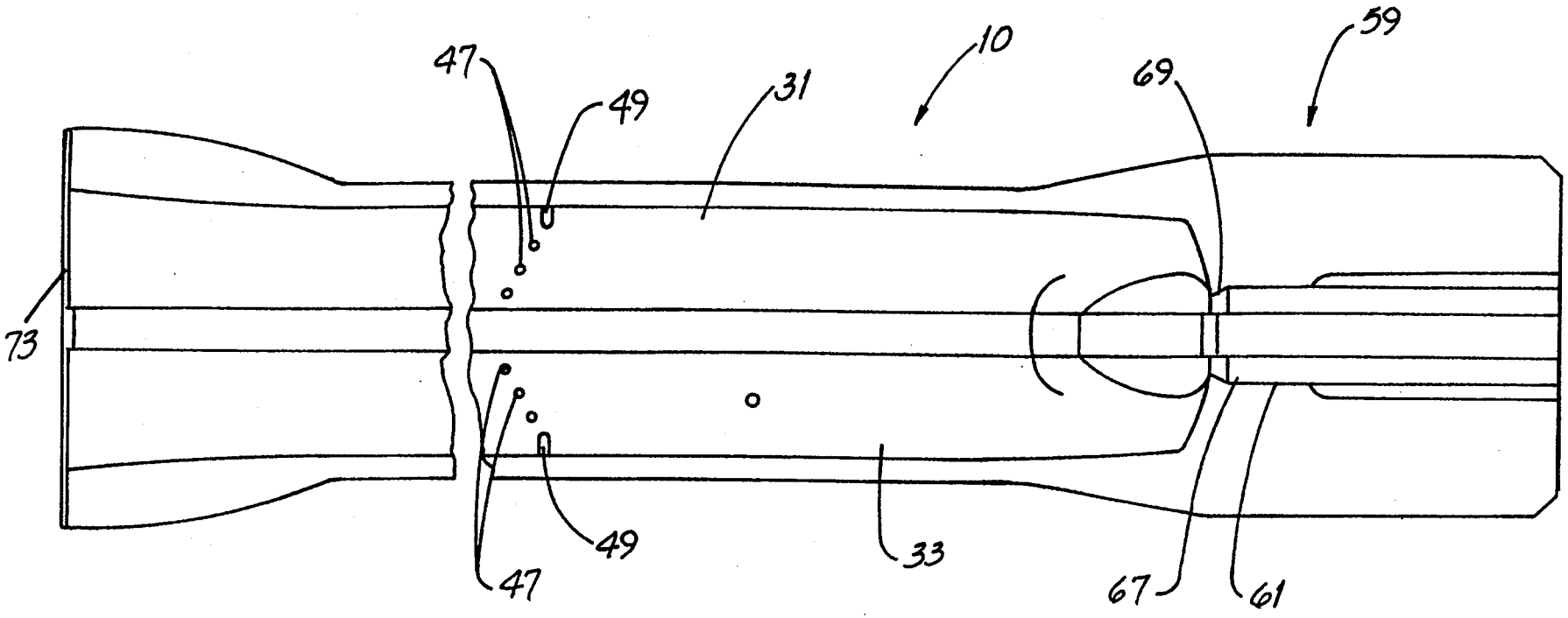
FIG. 6 is an upward-looking bottom plan view of the burner shown in FIG. 5 taken along the viewing plane 6—6 thereof.

Referring particularly to FIGS. 5 and 6, the burner 10 has a plurality of ignition ports 47 in each bottom panel portion 31, 33. The ports 47 in each portion 31, 33 are linearly arranged and "point toward" a notch-like edge ignition port 49 pierced in the edge 57 defined by the junction of a side strip 35, 37 and its contiguous bottom panel portion 31, 33. Further, the ignition port 49 is preferably directly below an aperture 19 in the side strip 35, 37. Ignition at any one of the ports 47, 49 effectively ignites, in sequence, gas flowing from all of the other ports 47, 49 and from the apertures 19.

Figure 7:
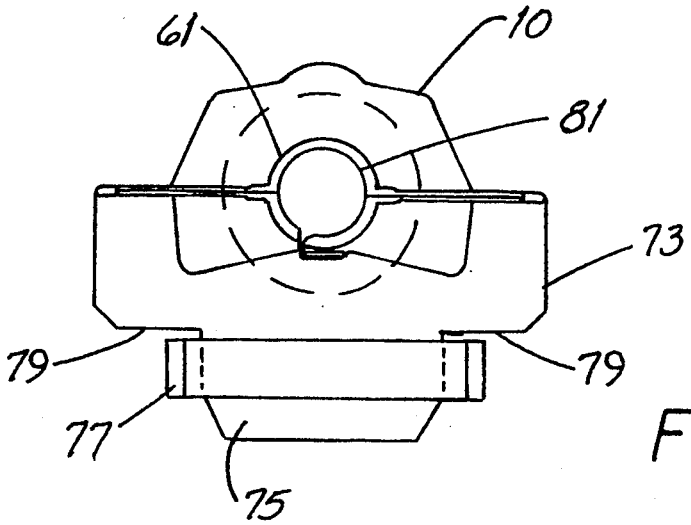
FIG. 7 is, generally, an end elevation view of the burner of FIG. 5 taken along the viewing plane 7—7 thereof and with the gas flow control valve omitted. The burner is shown in conjunction with a mounting bracket.

As shown in FIGS. 5 6 and 7, that end of the burner 10 opposite the gas valve receptacle 61 is crimped shut and a tongue 73 bent downward. The tongue 73 has a relatively narrow extension 75 which inserts downward into a mounting bracket 77 in a cooking grill kettle for burner support. Preferably, the width of the bracket 77 is only slightly greater than that of the extension 75 so that the tongue shoulders 79 bear against the top of the bracket 77.

Figure 8:
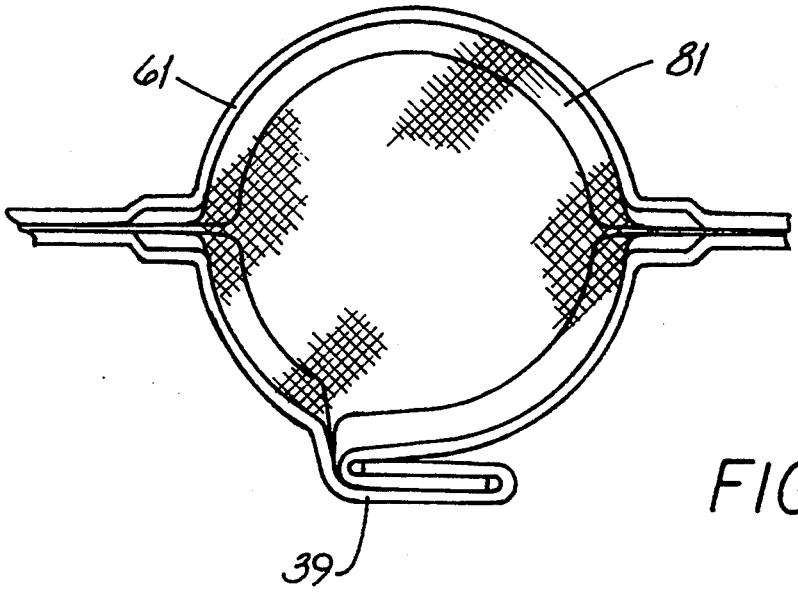
FIG. 8 is an enlarged view of that portion of the burner of FIG. 7 circumscribed by the dashed circle.

As shown in FIG. 8, placed in the interior of the gas valve receptacle 61 is an annular barrier screen 81 to help prevent insects, especially spiders, from finding their way into the burner 10 and creating a gas flow obstruction.

Referring now to FIGS. 9 through 29, the invention also involves a method for making a roll-formed tube burner 10. Such method includes the steps of providing an elongate strip 87 of material such as steel or aluminum having (a) a central portion 89, (b) a first lateral portion 91 and (c) a second lateral portion 93. Preferably, both lateral portions 91, 93 are contiguous with the central portion 89. Aspects of the method involve both piercing and deforming the strip 87. Preferably, the strip 87 is obtained from a large roll of such material, the exposed end of which is fed into a press used for the piercing operation described below.

Prior to the first deforming step, it is preferable to pierce the gas flow apertures 19 in the strip 87 and if (as it usually does) the burner 10 is to have an air inlet passage 65 and/or an ignition port 47 or 49, it is highly preferred to pierce the apertures 19, the passage 65 and the ports 47, 49 prior to deformation. A press is used to perform the piercing operation(s) prior to entry of the strip 87 into the first of several stages of roll forming.

Figure 9:
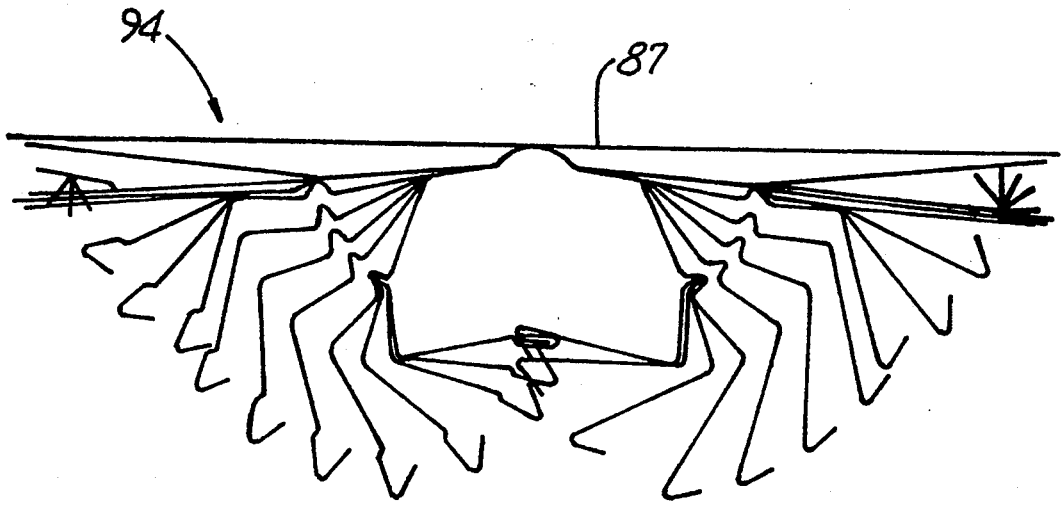
FIG. 9 is a representative "flower diagram" relating to the method of making the burner by roll forming.

FIG. 9 (representative) is what is known in the roll-forming industry as a "flower diagram" 94 because of its resemblance to the sequence of positions assumed by a blooming flower. For ease of understanding, each of FIGS. 10A and 11 through 29 represents one "stage" of the flower diagram 94 of FIG. 9. That is, FIG. 10A and FIGS. 11 through 29 illustrate the progression of deformation by bending, crimping or the like which occurs when making the new burner 10 in accordance with the inventive method. Each FIGURE in the sequence of FIGS. 11 through 29 represents deformation occurring at a particular roll forming stage.

Figure 10B:
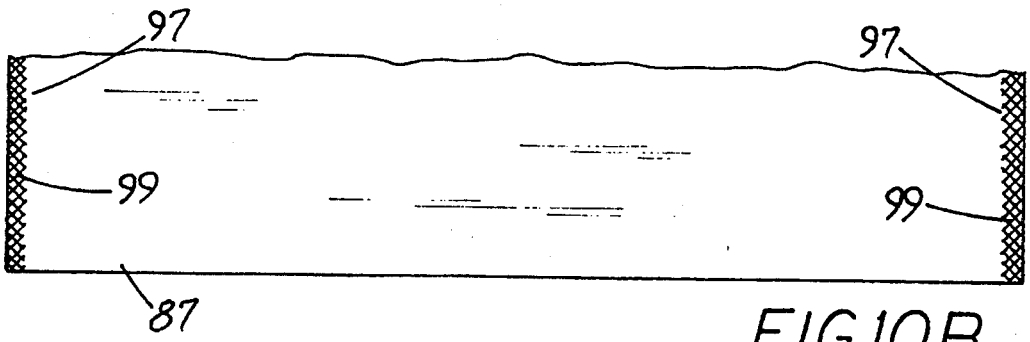
FIG. 10B is a top plan view of the strip of FIG. 10A taken along the viewing plane 10B—10B thereof and showing knurling of the edge portions of the strip.
Figure 10A:
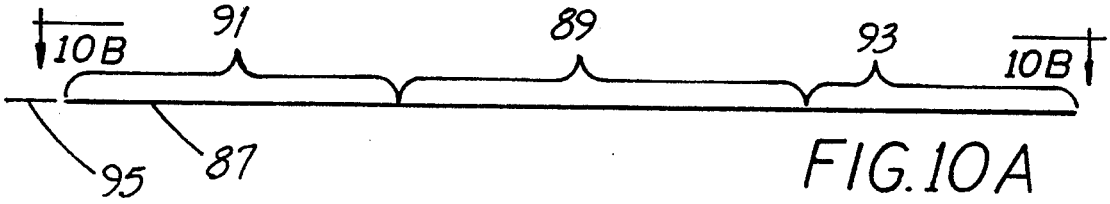
FIG. 10A is an edge view of a strip of, e.g., steel, used as a starting material for making the burner.
Figure 11:
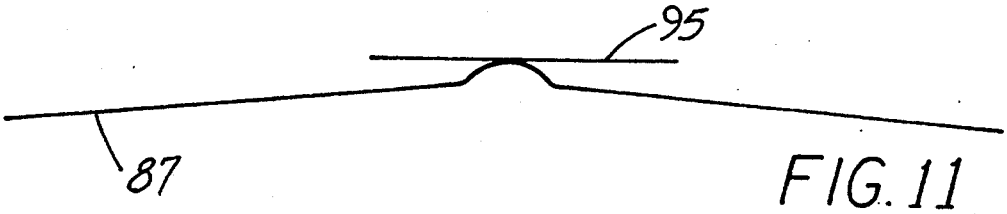
FIGS. 11 through 29 are sequential edge views of the strip of FIG. 10A illustrating how the shape of such strip is changed at each stage of roll forming.
Figure 12:
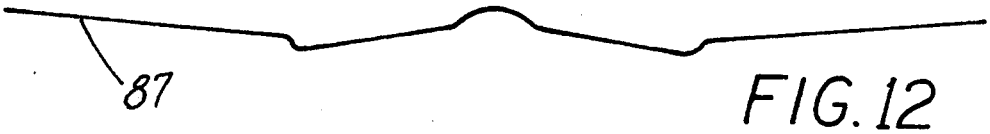
Figure 13:
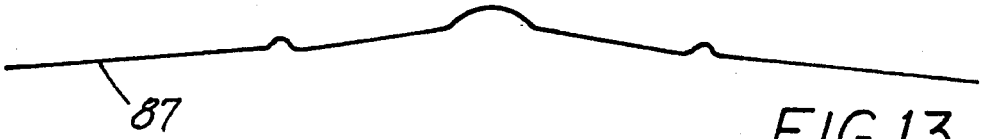
Figure 14:
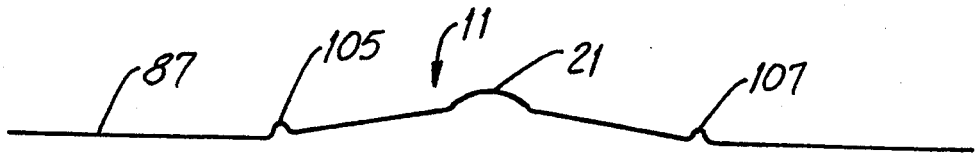
Figure 15:
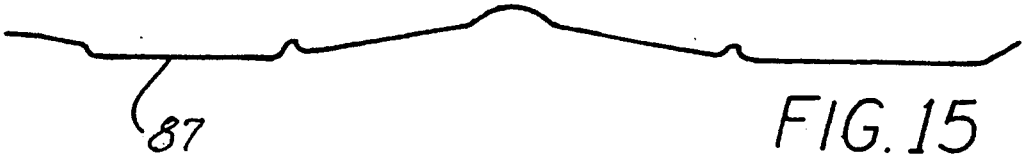
Figure 16:
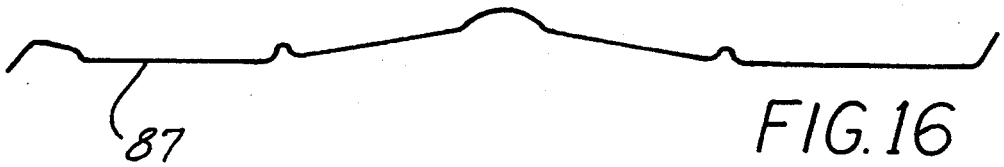
Figure 17:
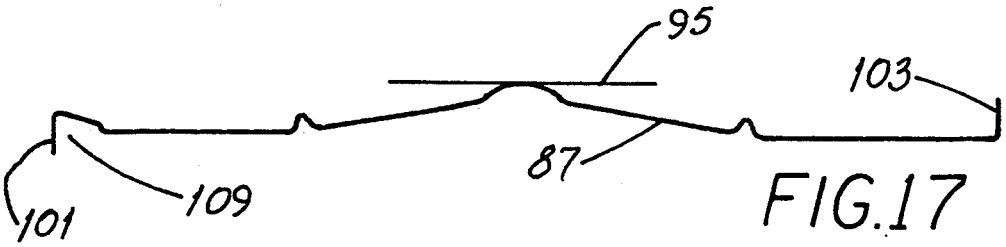
Figure 18:
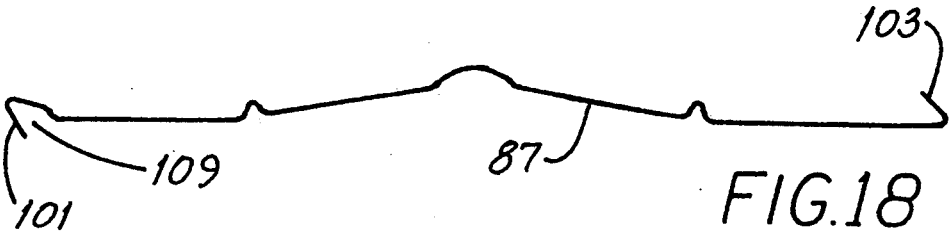
Figure 19:
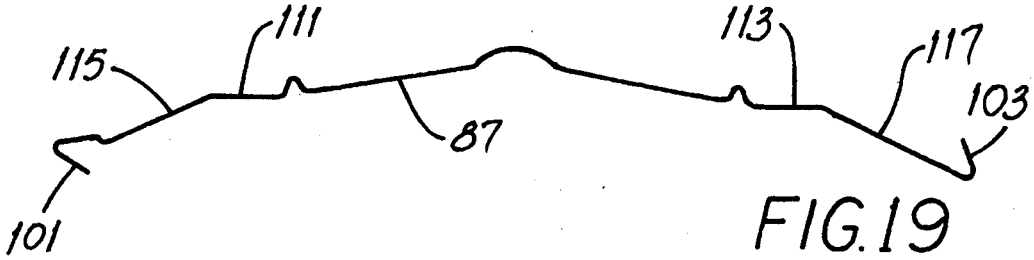
Figure 20:
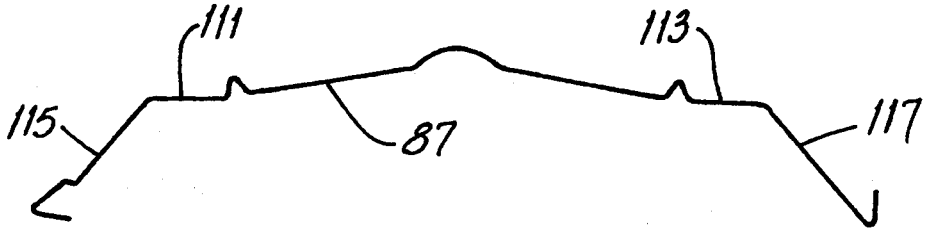
Figure 21:
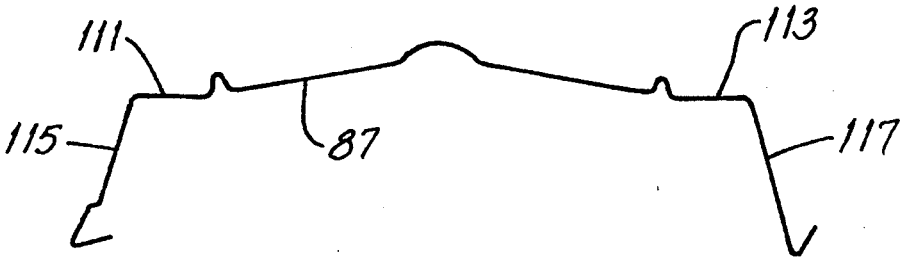
Figure 22:
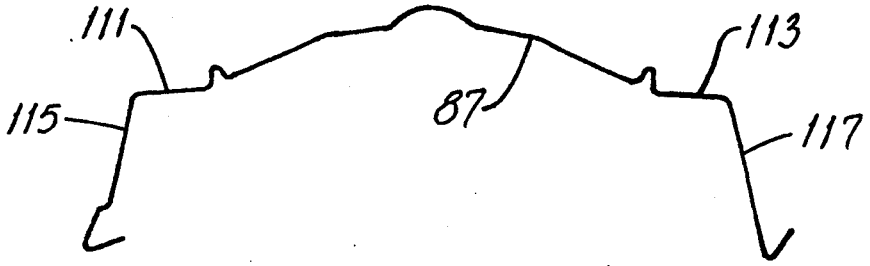
Figure 23:
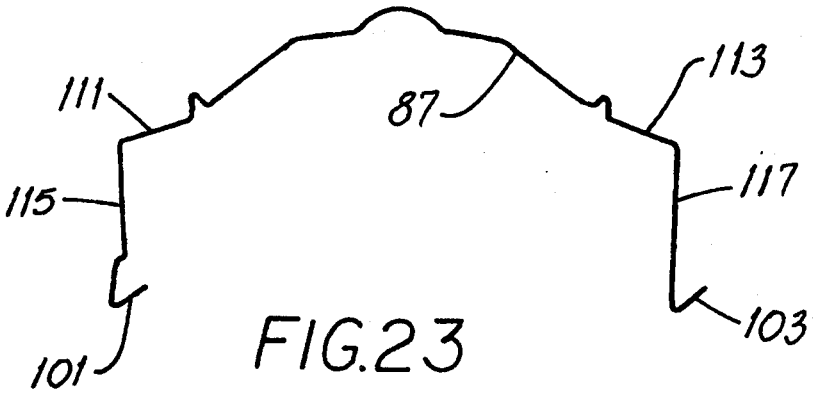
Figure 24:
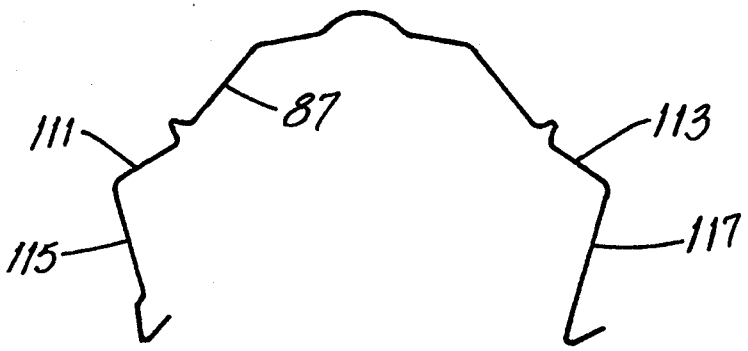
Figure 25:
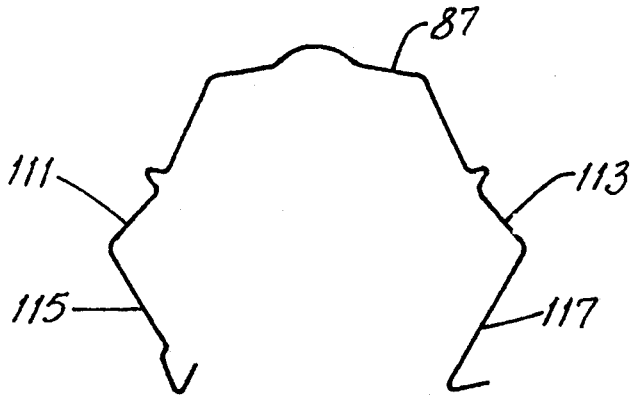
Figure 26:
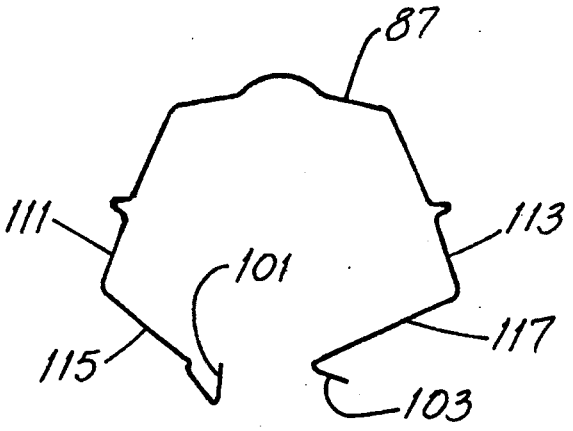
Figure 27:
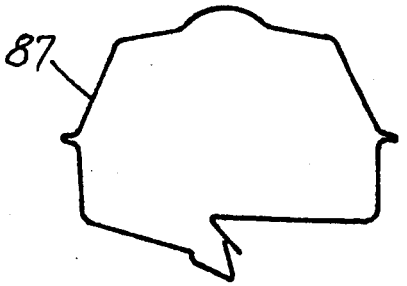

Referring to FIGS. 10A and 10B, after piercing and at the first stage of roll forming before the strip 87 is deformed from the reference plane 95, the edge portions 97 of the strip 87 are knurled (preferably on both sides) as indicated at 99. Knurling is desired so that when the tabs 101, 103 are interlocked as described below, they seal properly to substantially prevent the escape of gas through the lock seam 39. While industry standards do not require an absolutely gas-tight seam 39, such seam 39 must be sufficiently well sealed that any gas escaping therefrom under a specified pressure within the burner 10 is insufficient to support a flame.

Referring particularly to FIGS. 2, 3 and 4 through 14 in the deformation steps, the central portion 89 is deformed to define a burner first panel 11 having a burner ridge portion 21 and a pair of flange portions 105, 107. In the finished burner 10, the ridge portion 21 provides rigidity and helps direct liquid grease to a location where it drips harmlessly from the burner 10. The flange portions 105, 107 (which form flanges 15) help shield the gas flow apertures 19 from grease dripping from cooking food directly above the apertures 19 and from grease which has dripped onto the burner 10 and runs down the burner 10.

Referring particularly to FIGS. 2, 3, 4 and 15 through 18, each lateral portion 91, 93 is deformed to provide a tab 101, 103 therealong and to define a burner second panel 13. Preferably, deformation of each lateral portion 91, 93 includes the steps of deforming the first lateral portion 91 to provide a first tab 101 extending away from a reference plane 95 and deforming the second lateral portion 93 to provide a second tab 103 extending toward the reference plane 95. While it is possible to form the tabs 101, 103 in sequence, they are formed simultaneously in the preferred method.

Figure 28:
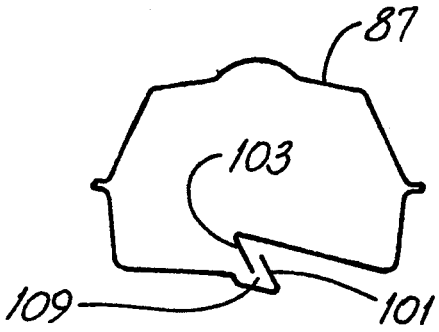
Figure 29:
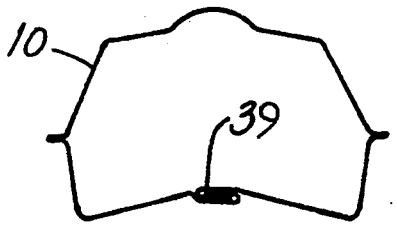

The firs tab 101 is formed to have an offset cavity-like portion 109. As shown in FIG. 28 the second tab 103 "nests" in such cavity-like portion 109. When so made, the tabs 101, 103 are readily interlocked (somewhat like interlocking the bent fingers of two hands) and crimped to form the lock seam 39 and an elongate tube-like structure is thereby provided.

As noted above, deformation of each lateral portion 91, 93 also defines a burner second panel 13. As shown in FIGS. 2, 3, 4 and 19 through 26, each lateral portion 91, 93 is bent to provide a burner side strip portion (first and second side strip portions 111 and 113, respectively) and a burner bottom panel portion, first and second bottom panel portions 115 and 117, respectively. Referring also to FIG. 1, preferably, bending of each lateral portion 91, 93 is in a manner such that apertures 19 are arranged along each side strip portion 111, 113 in a line 119 parallel to the ridge portion 21 and to an edge 57. It is also preferred that each bottom panel portion 115, 117 includes at least one ignition port 47.

After the tabs 101, 103 are interlocked, the resulting tube-like structure 121 (as represented by FIG. 1, for example) preferably has a substantially uniform cross-sectional area and shape along its entire length. Such structure 121 could be closed by plugs at the ends and a fuel/air fixture fed thereinto along a tube threaded into one of the plugs.

However, in a highly preferred method, the interlocking step is followed by the step of crimping an end 59 of the structure 121 to form a cylinder-like receptacle 61 as shown in FIGS. 3, 4 and 5. The invention effects certain economies in manufacture of a cooking grill since the receptacle 61 directly receives a gas valve 63 without the need for any extra hardware, gas flow tube mounting devices or the like.

In the embodiment of FIG. 4, the end 59 is crimped to form at least one flange-like primary air inlet passage 65, the long axis 123 of which is generally parallel to the long axis 125 of the receptacle 61. In a highly preferred embodiment, there are two such passages 65 and the gas valve 63 is between them. In the embodiment of FIGS. 3, 5 and 6, the end 59 is crimped to form the receptacle 61; the primary air inlet passage 65 is prior provided by piercing before the start of roll forming.

While the principles of this invention have been described in connection with specific embodiments, it should be understood clearly that these descriptions are made only by way of example and are not intended to limit the scope of the invention.

We claim:

1. A method for making a roll-formed tube burner including the steps of:

providing an elongate strip of material having (a) a central portion, and (b) a first lateral portion and a second lateral portion, both lateral portions being contiguous with the central portion;

deforming the central portion to define a burner first panel;

deforming each lateral portion to provide a tab therealong;

deforming each lateral portion to define a portion of a burner second panel; and, interlocking the tabs, thereby forming a lock seam and interlocked lateral portions forming the burner second panel, whereby an elongate tube-like structure is provided.

2. The method of claim 1 including, prior to the first deforming step, the steps of:

piercing a plurality of apertures in the elongate strip; and, knurling the lateral portions.

3. The method of claim 2 wherein:

the apertures are gas flow apertures;

the burner includes at least one air inlet passage and at least one ignition port; and, the piercing step includes piercing the inlet passage and the ignition port.

4. The method of claim 1 wherein:

the step of deforming the central portion includes forming a burner ridge portion.

5. The method of claim 4 wherein:

the step of deforming the central portion also includes forming a pair of flange portions.

6. The method of claim 1 wherein the step of deforming each lateral portion to provide a tab includes the steps of:

deforming the first lateral portion to provide a first tab extending away from a reference plane; and, deforming the second lateral portion to provide a second tab extending toward the reference plane.

7. The method of claim 1 wherein the step of deforming each lateral portion to define a portion of a burner second panel includes the steps of:

bending each lateral portion to provide a burner side strip portion and a burner bottom panel portion.

8. The method of claim 7 including, prior to the first deforming step:

piercing (a) a plurality of apertures, and (b) at least two ignition ports, and the bending step includes:

bending each lateral portion so that apertures are along each side strip portion and so that each bottom panel portion includes at least one ignition port.

9. The method of claim 1 wherein the structure includes a pair of ends and the interlocking step is followed by the step of:

crimping an end to form a cylinder-like receptacle.

10. The method of claim 3 wherein the structure includes a pair of ends and the interlocking step is followed by the step of:

crimping an end to form a cylinder-like receptacle.

11. The method of claim 8 wherein the structure includes a pair of ends and the interlocking step is followed by the step of:

crimping an end to form a cylinder-like receptacle.

* * * * *